United States Patent [19]

Wada

[11] Patent Number: 4,793,294

[45] Date of Patent: Dec. 27, 1988

[54] APPARATUS FOR CONTROLLING A VARIABLE-EFFECTIVE-LENGTH AIR INTAKE SYSTEM

[75] Inventor: Hiroki Wada, Toyota, Japan

[73] Assignee: Toyota Jidosha Kabushiki Kaisha, Japan

[21] Appl. No.: 838,360

[22] Filed: Mar. 11, 1986

[30] Foreign Application Priority Data

Mar. 12, 1985 [JP] Japan ..... 60-47385

[51] Int. Cl.[4] ..... F02B 75/18

[52] U.S. Cl. ..... 123/52 MB

[58] Field of Search ..... 123/52 M, 52 MB, 52 MV, 123/52 MC

[56] References Cited

U.S. PATENT DOCUMENTS 4,656,166 1/1986 Takeda ..... 123/52 MB

FOREIGN PATENT DOCUMENTS 59-58736 4/1984 Japan .

2117043 10/1983 United Kingdom ..... 123/52 MB

*Primary Examiner*—Charles J. Myhre

*Assistant Examiner*—David A. Okonsky

*Attorney, Agent, or Firm*—Finnegan, Henderson, Farabow, Garrett & Dunner

[57] ABSTRACT

The control apparatus is intended for use in controlling a variable-effective-length air intake system of the type which has two volumetric chambers connected, respectively, to two groups of engine cylinders and which incorporates a flow control valve for controlling the communication between the two volumetric chambers to vary the effective length of the intake system in response to the rotational speed and load of an internal combustion engine. The control apparatus comprises a control means that detects the rate of acceleration of the engine and selectively causes the flow control valve to be controlled according to the throttle valve aperture during an accelerating condition of the engine and according to the amount of intake air per one revolution of the engine during steady load condition. Such a selective control improves the responsiveness of the control apparatus during acceleration while ensuring accurate control during a steady load condition.

3 Claims, 3 Drawing Sheets

APPARATUS FOR CONTROLLING A VARIABLE-EFFECTIVE-LENGTH AIR INTAKE SYSTEM

BACKGROUND OF THE INVENTION

1. Field of the Invention

The present invention relates to an apparatus for controlling an air intake system of an internal combustion engine. More particularly, it relates to an apparatus for controlling an air intake system having a variable effective length.

2. Description of the Related Art

This invention is directed to an apparatus for controlling a variable-effective-length air intake system disclosed in a copending U.S. patent application Ser. No. 805,740 filed Dec. 6, 1985 now U.S. Pat. No. 4,738,229 and assigned to the assignee of the present invention. The air intake system disclosed therein comprises a surge tank, the inside of which is divided by a partition wall into two elongated parallel volumetric chambers. The surge tank has a portion extending beyond the branch tube located at a position most remote from the air inlet of the surge tank. The partition wall of the surge tank extension is provided with an opening communicating the volumetric chambers with each other. This opening is opened and closed by a control valve operated by an actuator in response to varying engine operating conditions. When the control valve is closed to isolate the two volumetric chambers of the surge tank from each other, the air intake system operates as if the effective length thereof is elongated to match a lower resonance frequency of the air column in the intake system, thereby increasing the flow rate of the intake air and generating a high output torque during a lower engine speed. Conversely, when the control valve is opened to communicate the volumetric chambers with each other, the effective length of the air intake system in reduced, thereby reducing the flow resistance through the system and improving the power at high speed operation of the engine.

The control valve is controlled, for example, by a vacuum actuator which, in turn, is controlled by an electronic control unit. The effective length of the air intake system is controlled, in the first place, in accordance with the rotational speed of the engine, in such a manner that, during high speed operation of the engine, the effective length is reduced and, during low speed operation, the effective length is extended as mentioned above. During the low speed condition, however, it is desirable to reduce the effective length of the air intake system when the engine is running under a light load condition, in order to reduce the flow rate of the intake air and, hence, the fuel comsumption. Accordingly, in the second place, the effective length of the air intake system is controlled depending on the engine load.

Detection of the engine load may be performed in various ways. For example, manifold vacuum may be used, or in another method, the engine load is decided on the basis of the amount of intake air drawn into the engine per one revolution of the engine. Alternatively, the throttle valve opening may be used as a parameter reflecting the engine load. The manifold vacuum and the amount of intake air per revolution are capable of adequately accurately reflecting the engine load during the steady load condition but have a disadvantage in that their responsiveness to the transitional condition of the engine load is so poor that an unacceptable delay is caused in the control of the effective length of the intake system. The throttle valve opening will quickly respond to a rapid change in the engine load but will not accurately refect the engine load during a steady load condition.

SUMMARY OF THE INVENTION

The object of the present invention is to provide an apparatus for controlling a variable-effective-length air intake system, which apparatus provides an improved responsiveness during a transitional condition of the engine.

The apparatus for controlling the variable- effective-length air intake system according to the present invention is designed so that, during the transitional period of the engine load, the effective length of the system is controlled based on the throttle valve opening which rapidly reflects the changes in the engine load and, during the steady load condition, the air intake system is controlled in accordance with the amount of intake air per one revolution of the engine, which accurately reflects the engine load.

DESCRIPTION OF THE PREFERRED EMBODIMENT

Figure 1:
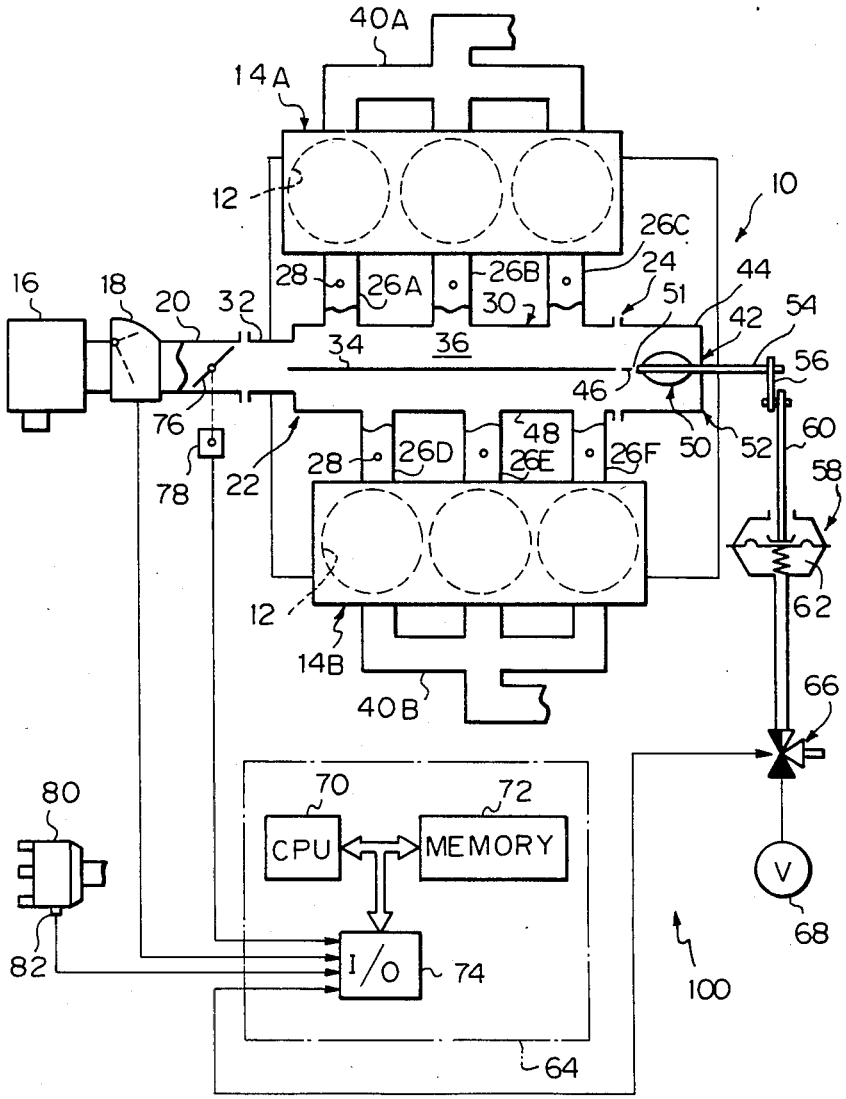
FIG. 1 is a schematic representation, partly in cross-section and partly in block diagrammatic form, of a V-6 engine having a variable-effective-length air intake system controlled by the apparatus according to the present invention.

Referring now to the drawings, wherein a preferred embodiment of the present apparatus 100 is shown, FIG. 1 schematically illustrates a V-6 fuel injection engine 10 having an air intake system 22 with a variable effective length. The air intake system 22 is similar to that described in the copending patent application Ser. No. 805,740 filed Dec. 6, 1985, the disclosure of which is incorporated by reference herein. More specifically, the engine 10 comprises inclined cylinder banks 14A, 14B each having three engine cylinders as indicated by the broken circles 12. Intake air for the respective engine cylinders 12 is fed through a air cleaner 16, an air flow meter assembly 18, a throttle body assembly 20, and the air intake system 22. The air intake system 22 includes a surge tank 24 and six branch tubes 26A through 26F integral therewith or separate therefrom. Respective intake tubes 26A to 26F have fuel injectors 28 provided in a known manner for injecting controlled amounts of fuel into the intake air drawn into the cylinder 12, to form a combustible mixture.

The surge tank 24 includes an elongated hollow outer shell 30 extending lengthwise of the engine 10 and has an air inlet 32 connected to the throttle body assembly 20. The surge tank 24 is provided with a partition wall 34 that extends therethrough in the longitudinal direction to divide the inside of the shell 30 into two volumetric chambers 36 and 38. One volumetric chamber 36 is connected through respective intake tubes 26A to 26C to the combustion chambers of the first cylinder bank 14A and the other chamber 38 is connected to the combustion chambers of the second cylinder bank 14B through respective branch tubes 26D to 26F. The cylinder banks 14A and 14B are provided with respective exhaust manifolds 40A and 40B.

The surge tank 24 has an extension 42 that extends opposite the air inlet 32 beyond the intake tube 26F which is situated at a position most remote from the inlet 32. The surge tank extension 42 comprises a shell extension 44 and a partition wall extension 46. The surge tank extension 42 is made separate from the main body 48 forming the remainder of the surge tank and is removably secured thereto by conventional fastening means such as bolts. The extension 42 and main body 48 together form the surge tank assembly 24. The partition wall extension 46 is provided with an aperture 51 which is opened and closed by a flow control valve in the form of a butterfly valve 50. The surge tank extension 42 and the flow control valve 50 together form a detachable valve assembly 52 which is easy to manufacture and facilitates maintenance and inspection.

The flow control valve 50 is controlled by the control apparatus 100 in order to reduce or extend the effective length of the air intake system 22. The apparatus 100 includes a vacuum actuator 58 having a movable output rod 60 connected through a linkage 56 to the valve shaft 54 of the control valve 50. The actuator 58 opens and closes the butterfly valve 50 in response to the amount of vacuum applied to a vacuum chamber 62. In the illustrated embodiment, the vacuum actuator 58 is designed to normally open the flow control valve 50 and to close the valve 50 when vacuum is applied to the vacuum chamber 62. The vacuum to be applied to the vacuum actuator 58 is obtained at a vacuum source 68, such as a vacuum pump or a vacuum port in the intake manifold, and is controlled by a solenoid valve 66 controlled by an electronic control unit 64 which implements part of the present apparatus 100. The solenoid valve 66 is designed to communicate the source of vacuum 68 with the vacuum chamber 62 when energized and to connect the chamber 62 to the ambient atmosphere when deenergized.

The electronic control unit (ECU) 64 is a conventional programmable digital microcomputer which is primarily used to control the electronic fuel injection system of the engine and comprises a central processing unit (CPU) 70, a memory device 72, and an I/O interface 74 which is connected to the air flow meter 18, a throttle sensor 78 associated with a throttle valve 76 of the throttle body 20, and a crank angle sensor 82 incorporated in a distributor 80. The air flow meter 18 provides an analog signal representing the flow rate Q of intake air drawn into the engine 10. The throttle sensor 78 senses the opening of the throttle valve 76 and provides an analog signal indicative of the throttle opening. The crank angle sensor 82 delivers a pulse signal for a predetermined rotational angle of the engine crank shaft (not shown) and the ECU 64 calculates the rotational speed of the engine in the known manner upon receipt of each pulse.

Figure 2:
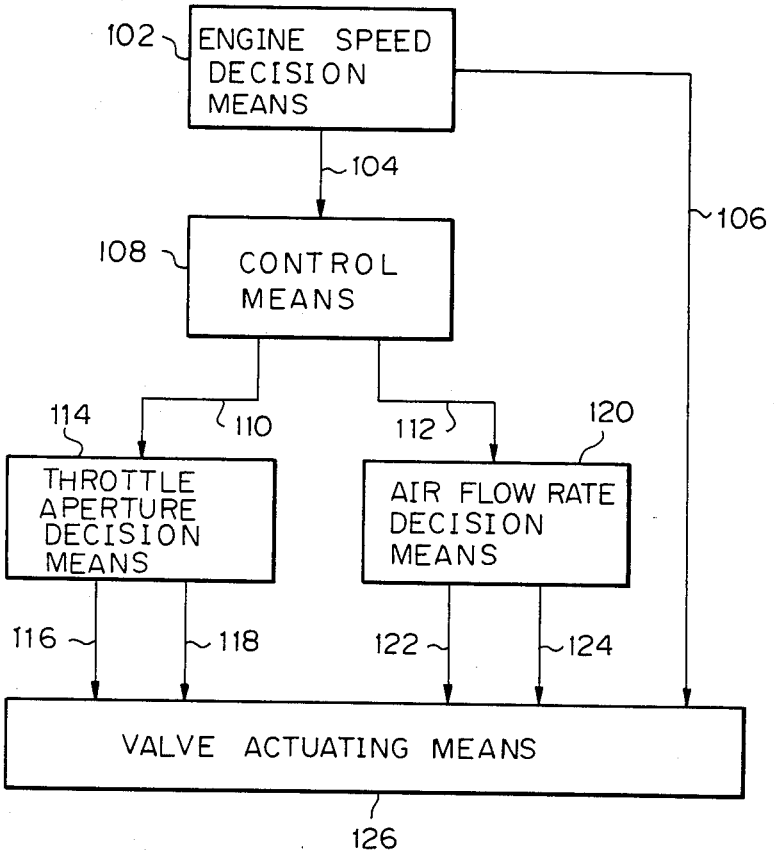
FIG. 2 is a block diagram showing the control apparatus of the invention.

FIG. 2 is a block diagram showing the control apparatus 100. The engine speed decision means 102 detects the rotational speed of the engine, compares the actual engine speed with a predetermined first value (for example, 2000 rpm), delivers a first signal over a line 104 when the actual engine speed is less than the first value, and delivers a second signal over a line 106 when the engine speed is greater than the first value.

The control mean 108 is operated in response to the first signal, detects the rate of acceleration of the engine, compares the acceleration rate with a predetermined second value, delivers a third signal over a line 110 when the acceleration rate is greater than the second value, and delivers a fourth signal over a line 112 when the acceleration rate is less than the second value. Preferably, the decision of the acceleration rate is performed in accordance with the rate of variation in the opening of the throttle valve 76, which is calculated based on the signal from the throttle sensor 78.

The throttle aperture decision means 114 is operated in response to the third signal, detects the throttle valve 76 opening, compares the actual throttle opening with a predetermined third value, delivers a fifth signal over a line 116 when the actual throttle aperture is greater than the third value, and delivers a sixth signal over a line 118 when the throttle opening is less than the third value.

The air flow rate decision means 120 is operated upon receipt of the fourth signal. The means 120 detects the flow rate Q of the intake air, which is divided by the engine rpm NE to calculate the amount Q/N of intake air drawn per one revolution of the engine. The air flow rate decision means 120 then compares the amount Q/N with a predetermined fourth value, delivers a seventh signal over a line 122 when the amount Q/N is greater than the fourth value, and delivers an eighth signal over a line 124 when the amount Q/N is less than the fourth value.

The valve actuating means 126 opens the flow control valve 50 upon receipt of the second, sixth, and eighth signals and closes the valve 50 upon receipt of the fifth and seventh signals.

The valve actuating means 126 may comprise the vacuum actuator 58, the solenoid valve 66, the vacuum source 68, and the ECU 64 implementing part thereof, and the foregoing engine speed decision means 102, the control means 108, the throttle aperture decision means 114, and the air flow rate decision means 120 may be implemented by the ECU 64.

Figure 3:
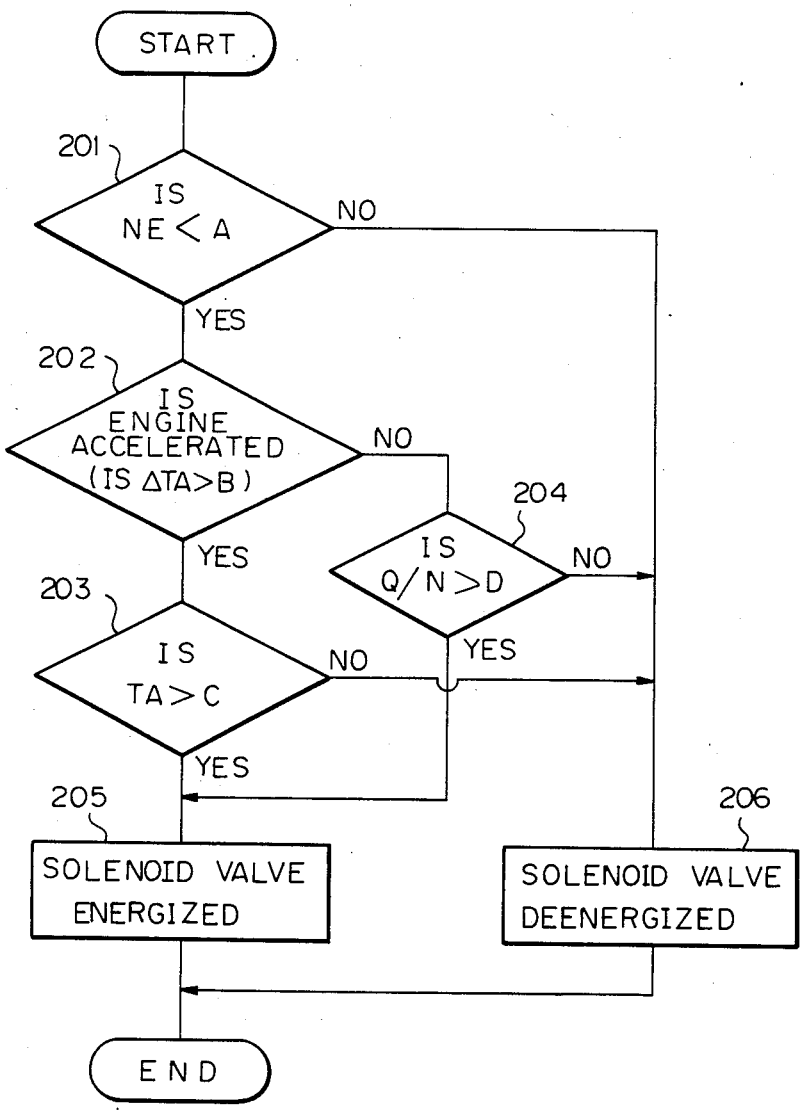
FIG. 3 is a flow diagram of the control unit.

Referring to the flow diagram of FIG. 3 showing the operation of the ECU 64, at point 201, the ECU 64 calculates the rotational speed NE of the engine and compares the actual engine speed with a present value A which may be selected to be in the range of 2,000 to 3,000 rpm. When the actual engine speed NE is greater than the value A, the ECU carries out the step at point 206 wherein the solenoid valve 66 is deenergized, thereby subjecting the vacuum chamber 62 of the vacuum actuator 58 to the atmospheric pressure and causing the flow control valve 50 to be opened. In this state, the intake air drawn into one of the volumetric chambers 36 and 38 is allowed to freely enter the other volumetric chamber so that any engine cylinder moving under in take stroke will draw intake air through both volumetric chambers 36 and 38. This results in obtaining an effect as if the effective length of the intake system is reduced so that the effective length is matched to a high rotational speed and the flow resistance of the system is reduced, thereby increasing the engine power at high speed.

When the actual engine speed NE is less than the preset value A, the step at point 202 is performed to decide whether the engine is in an accelerating condition. This may be done by calculating the variation $\Delta TA$ per unit time interval in the throttle aperture TA and by comparing the throttle aperture variation $\Delta TA$ with a predetermined second value B. Depending on the result of this comparison, the control of the flow control valve will be changed over between a condition wherein the engine load is detected according to the throttle aperture and another condition wherein the load is sensed in accordance with the amount Q/N of intake air per one revolution of the engine. That is, when the throttle aperture variation is greater than the preset value B, meaning the engine is operating under an accelerating condition, the step at point 203 is executed wherein the actual throttle aperture TA is detected based on the signal from the throttle sensor 78 and the actual throttle aperture TA is compared with a predetermined value C, for example, 6°.

If the throttle aperture is greater than the preset value C, then the solenoid valve 66 is energized at point 205 causing the vacuum at the source 68 to be applied to the vacuum chamber 62 of the actuator 58, thereby closing the flow control valve 50 and interrupting the communication between the volumetric chambers 36 and 38. As a result, the cylinder banks 14A and 14B will draw intake air only through associated volumetric chambers 36 and 38, respectively, thereby producing the effect as if the effective length of the intake system is increased, to enhance the low speed engine torque due to the inertia supercharging effect.

If in the decision of point 203 the throttle aperture is less than the preset value C, then the solenoid valve 66 is deenergized at point 206 to thereby open the flow control valve 50.

In this manner, the flow control valve 50 is controlled depending on the throttle aperture when the engine load is in a transitional condition. It should be appreciated that, because the throttle aperture varies in response to the movement of the accelerator pedal and quickly reflects the changes in the engine load, the responsiveness of the control system is improved by controlling flow control valve in accordance with the throttle aperture during a transitional condition of the engine.

If in the decision at point 102 the engine is in the steady load condition, then the engine load is determined at point 204 based on the amount Q/N of intake air per one revolution of the engine. To this end, the ECU 64 calculates the amount Q/N from the air flow rate Q sensed by the air flow meter 18 and from the engine rotational speed NE, and compares the thus-calculated amount Q/N with a predetermined value D. If the amount Q/N is greater than the value D, then the solenoid valve 66 is energized at point 205 to close the flow control valve 50. Conversely, if the amount Q/N is less than the preset value D, then the valve 66 is deenergized at point 206 thereby opening the valve 50 to provide the reduced effective length effect. In this manner, during the steady load condition of the engine, the flow control valve 50 is controlled depending on the amount Q/N, which more accurately reflects the engine load.

I claim:

1. Apparatus for controlling a variable-effective-length air intake system of an internal combustion engine, said air intake system having a throttle valve for controlling a flow rate of air drawn into the engine and a flow control valve for varying an effective length of said intake system, said flow control valve being operable to reduce the effective length of the system when opened and to extend said length when closed, said apparatus comprising:

(a) first means for detecting a rotational speed of the engine, said first means delivering a valve opening signal under a high speed rotational condition of the engine and delivering a control signal under a flow speed rotational condition of the engine;

(b) load sensing means responsive to said control signal for providing a valve opening signal when the engine load is low, and for providing a valve closing signal when the engine load is high, said load sensing means including alternate means for sensing engine load during accelerating and non-accelerating engine conditions, said load sensing means including (i) second means for detecting the degree of opening of said throttle valve and delivering a valve closing signal when said throttle valve is open greater than a preset degree, and a valve opening signal when said throttle valve is open less than said preset degree, (ii) third means for detecting the amount of intake air drawn into the engine per one revolution thereof and delivering a valve closing signal in response to said detected amount being greater than a preset amount and a valve opening signal in response to said detected amount being less than said preset amount, and (iii) control means responsive to said control signal for detecting the rate of acceleration of the engine and exclusively selectively operating said second and third means at times when said first means delivers said control signal, said control means operating said second means in response to an accelerating condition of the engine and operating said third means in response to a non-accelerating condition; and (c) actuating means operatively connected to said first means and to said control means for closing said flow control valve in response to a valve closing signal and opening said flow control valve in response to a valve opening signal.

2. Apparatus according to claim 1, wherein said control means detects the acceleration rate of the engine according to a rate of variation in the degree of throttle valve opening and operates said second means when said rate of variation is greater than a preset value.

3. Apparatus for controlling a variable-effective-length air intake system of an internal combustion engine, said air intake system having a throttle valve for controlling the flow rate of air drawn into the engine and a flow control valve for varying the effective length of said air intake system, said flow control valve being operable to reduce the effective length of the system when opened and to extend said length when closed, said apparatus comprising:

(a) first means for detecting the rotational speed of the engine, comparing said speed with a predetermined first value, delivering a first signal when said speed is less than said first value, and delivering a second signal when said speed is greater than said first value;

(b) second means responsive to said first signal for detecting the rate of acceleration of the engine, comparing said acceleration rate with a predetermined second value, and exclusively selectively delivering a third signal when said acceleration rate is greater than said second value, and a fourth signal when said acceleration rate is less than said second value;

(c) third means responsive to said third signal for detecting the degree of opening of said throttle valve, comparing said detected degree with a predetermined third value, delivering a fifth signal when said detected degree is greater than said third value, and delivering a sixth signal when said detected degree is less than said third value;

(d) fourth means responsive to said fourth signal for detecting the amount of intake air drawn into the engine per one revolution thereof, comparing said amount with a predetermined fourth value, delivering a seventh signal when said amount is greater than said fourth value, and delivering an eighth signal when said amount is less than said fourth value; and (e) actuating means for opening said flow control valve in response to any one of said second, sixth, and eighth signals, thereby reducing the effective length of the air intake system, and closing said flow control valve in response to any one of said fifth and seventh signals, thereby extending the effective length.

* * * * *